US006409361B1

(12) United States Patent
Ikeda

(10) Patent No.: US 6,409,361 B1
(45) Date of Patent: Jun. 25, 2002

(54) LIGHT-EMITTING DIODE INDICATOR LAMP

(75) Inventor: Akito Ikeda, Yao (JP)

(73) Assignee: Patlite Corporation, Osaka (JP)

( * ) Notice: Subject to any disclaimer, the term of this patent is extended or adjusted under 35 U.S.C. 154(b) by 0 days.

(21) Appl. No.: 09/528,503

(22) Filed: Mar. 20, 2000

(30) Foreign Application Priority Data

Mar. 19, 1999 (JP) ..... 11-076110

(51) Int. Cl.[7] ..... F21V 3/00

(52) U.S. Cl. ..... 362/240; 362/227; 362/249; 362/250

(58) Field of Search ..... 362/800, 555, 362/543, 544, 545, 227, 235, 236, 237, 240, 249, 252, 310, 362, 363

(56) References Cited

U.S. PATENT DOCUMENTS 4,929,866 A 5/1990 Murata
5,054,885 A 10/1991 Melby
5,136,483 A 8/1992 Schoniger et al.
5,148,146 A 9/1992 Murphy
5,237,490 A * 8/1993 Ferng ..... 362/183
5,608,290 A * 3/1997 Hutchisson et al. .... 315/200 A
5,642,933 A * 7/1997 Hitora ..... 362/243
5,669,703 A * 9/1997 Wheeler et al. ..... 362/249
5,688,042 A * 11/1997 Madahi et al. ..... 362/240
5,769,532 A 6/1998 Sasaki
5,806,965 A * 9/1998 Deese ..... 362/249
5,890,794 A * 4/1999 Abtahi et al. ..... 362/294
6,048,083 A * 4/2000 McDermott ..... 362/337

* cited by examiner

*Primary Examiner*—Sandra O'Shea
*Assistant Examiner*—Ismael Negron
(74) *Attorney, Agent, or Firm*—Koda & Androlia

(57) ABSTRACT

A light emitting diode indicator lamp comprising a single globe or a plurality of globes arranged one on the other and LEDs installed in the globe(s) as the light source so that the LEDs are disposed at the prescribed intervals on or near the inner circumferential surface of the globe(s) and diffusing light from the LEDs travels diametrically in the globes(s) and is illuminated to the outside of the globe(s).

15 Claims, 15 Drawing Sheets

LIGHT-EMITTING DIODE INDICATOR LAMP

BACKGROUND OF THE INVENTION

1. Field of the Invention

The present invention relates to a light-emitting diode (LED) indicator lamp that uses LEDs as its light source and is used as, for instance, a warning lamp.

2. Prior Art

Indicator lamps that use LED light sources have long been a preferred choice as illuminating devices such as status and warning lights. The reasons for this include the fact that they do not require frequent replacement of the light source, as do candescent lamps, nor are they vulnerable to shock and vibration. In particular, lamps that use LEDs as their light source are currently used extensively at entrances and exits, and at construction sites, etc. where safety is a concern.

However, since the amount of light given off by an LED is small, in prior art LED indicator lamps, a large number of LEDs are installed on, for instance, a circuit board, and the circuit board is set in the center of the globe (which is an illuminating surface of the lamp) so that light from the LEDs is emitted outward from the center of the globe toward its circumference. Nonetheless, the distance between the LEDs and the circumference of the globe is short; as a result, the light from the LEDs reaches the globe before it is adequately diffused. Thus, it appears to an observer as a grainy light source; and even though a large number of LEDs are used, it is not possible to make efficient use of their emitted light.

One approach to solve this problem is to use a reflecting means so as to diffuse the light. For instance Japanese Utility Model Application Laid-Open (Kokai) No. S62-78770 discloses an hourglass-shaped reflector, and Japanese Utility Model Application Laid-Open (Kokai) No. S63-176214 teaches a reflecting mirror formed as a paraboloid of rotation.

In these prior arts, however, the light is emitted so that it has an appearance of a grainy or striped light source, which in fact degrades visibility. So as to obtain an adequate light emission from the LEDs, Japanese Registered Utility Model No. 2568899 discloses a lamp with a conical reflecting surface. However, this lamp has some problems. Due to the demanded reflection efficiency, the brightness is poor compared to that obtained with a direct light. Also, since the reflecting means is installed in the globe (indicator) for diffusing the light emitted from the LEDs, the manufacturing costs increase significantly, and the overall size of the globe also increases.

SUMMARY OF THE INVENTION

Accordingly, the present invention is to solve the above-described problems of the prior art.

The object of the present invention to solve problems associated with the installation of LEDs in the center of a globe and problems associated with the use of a reflecting means, thus providing a light-emitting diode indicator lamp that makes more efficient use of the light emitted from the installed LEDs.

Another object of the present invention is to solve the above problems of the prior art by configurations that can improve the efficiency of diffused light emitted from the LEDs, while at the same time simplifying the structure, thus achieving a cost reduction.

More specifically, the present invention is a light-emitting diode indicator lamp which comprises an indicator globe or indicator globes arranged one on the other in stages and a plurality of light emitting diodes (LEDs) installed in the globe(s) as a light source, and the plurality of light-emitting diodes are disposed at prescribed intervals on or near the inner circumferential surface of the globe(s) so that the diffusing light from each one of the LEDs travels toward an area on the inner circumferential surface of the globe that is diametrically opposite from such each one of the light-emitting LEDs.

Since the light emitted by a light source, which is an LED and disposed in the inner circumferential surface of a globe(s), travels toward locations on the opposite side (or the facing surface) of the glove, a sufficient distance for the light to spread out can be obtained, and a uniform light distribution is obtained. Since no reflecting means is installed in the light path, the light does not attenuate, resulting in more efficient use of the LEDs and a conservation of power.

Furthermore, since no reflecting means is used, it is possible to reduce cost; and since there are fewer components to be used, it is possible to improve reliability.

In the present invention, LEDs are provided on or near the inner circumferential surface of the globe, and these light-emitting diodes can be mounted on a ring-shaped base provided around the inner circumferential surface of the globe. Thus, the installation of the LEDs in the indicator lamp is greatly simplified.

In addition, the ring-shaped base can be a rib that is formed as an integral part of the globe and disposed on the inner circumferential surface of the globe. In this case, by way of integrally forming the rib in the globe by a synthetic resin as a ring-shaped mounting base, only needs to install the LEDs in the proper portions of the rib. Thus, the installation of the LEDs is very simple.

Furthermore, the ring-shaped base can be a narrow plate that is installed around the inner circumferential surface of the globe. With this narrow plate type base, the LEDs are installed in advance on the base, and then such a base with the LEDs thereon is installed in the globe by simply mounting the base around the inner circumferential surface of the globe. The narrow plate can be a printed circuit board (PCB), and this can further simplify the structure.

Furthermore, the ring-shaped base can be a cylinder formed from sheeting or film to be installed around the inner circumference of the globe. With this structure, the LEDs are provided in a cylinder made of light-weight sheeting or film, and it can reduce the weight and cost of the overall indicator lamp.

In addition, the ring-shaped base can be obtained by joining a plurality of frames together into a ring shape. With this ring-shape frame, it is possible to reduce the weight and cost of the indicator lamp as in the case of a sheeting or film ring-shaped base. Further, the void-to-solid ratio for the light emitted by the LEDs is improved, and there will be less components that block the light.

Furthermore, the light-emitting diode indicator lamp can be obtained with a wire installed around the inner circumferential surface of the globe. The use of wire as the ring-shaped base can provide an even greater weight and cost reduction and further improvement in void-to-solid ratio.

In the present invention, the LEDs are directly disposed in the globe circumferential surface or on a ring-shaped base provided inside the globe. However, in the present invention, the light-emitting diodes can be provided on a connecting member that is connected to a shade plate of the globe and located near at the inner circumference of the globe. With this structure, the LEDs can either be mounted on a connecting member suspended downward from an upper shade plate or on a connecting member extending upward from a lower shade plate. This provides a major advantage in that the mounting of the LEDs on the shade plates can be done during fabrication of the shade plates. Thus, the task of mounting the LEDs in the globe can be greatly simplified.

Furthermore, in the present invention, the LEDs emit light directly or straight toward (normal to) a facing area of the inner circumference of the globe; however, the LEDs can be disposed so as to emit light in an oblique direction. With this arrangement, an oblique emission of light can be realized, and this is advantageous in terms of changing the directivity of the emitted light.

Furthermore, in the present invention, not only can the globe be made so that it transmits light emitted by the LEDs to the outside, but the globe can be formed as a liquid crystal display (LCD) panel. With this LCD panel globe, the light from the LEDs is used as a backlight for an LCD display for displaying text, symbols and graphics (i.e., information to be conveyed to an observer). Thus, the globe can be used as an indicator having another function than a lamp that merely emits lights.

DETAILED DESCRIPTION OF THE PREFERRED EMBODIMENTS

Figure 1:
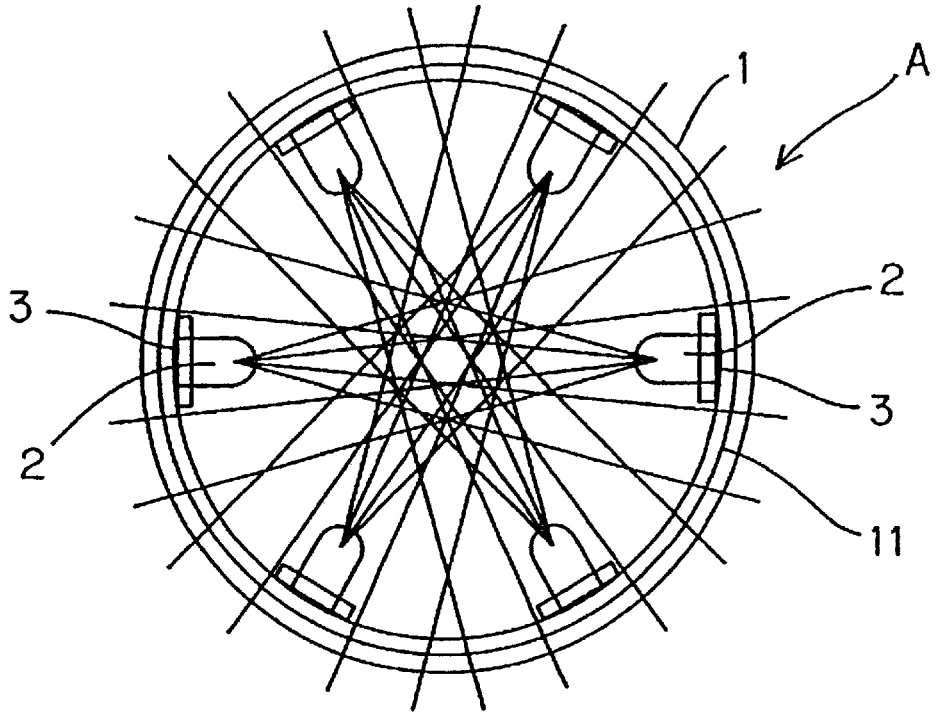
FIG. 1 is a top view of the first embodiment of the LED indicator lamp according to the present invention.
Figure 2:
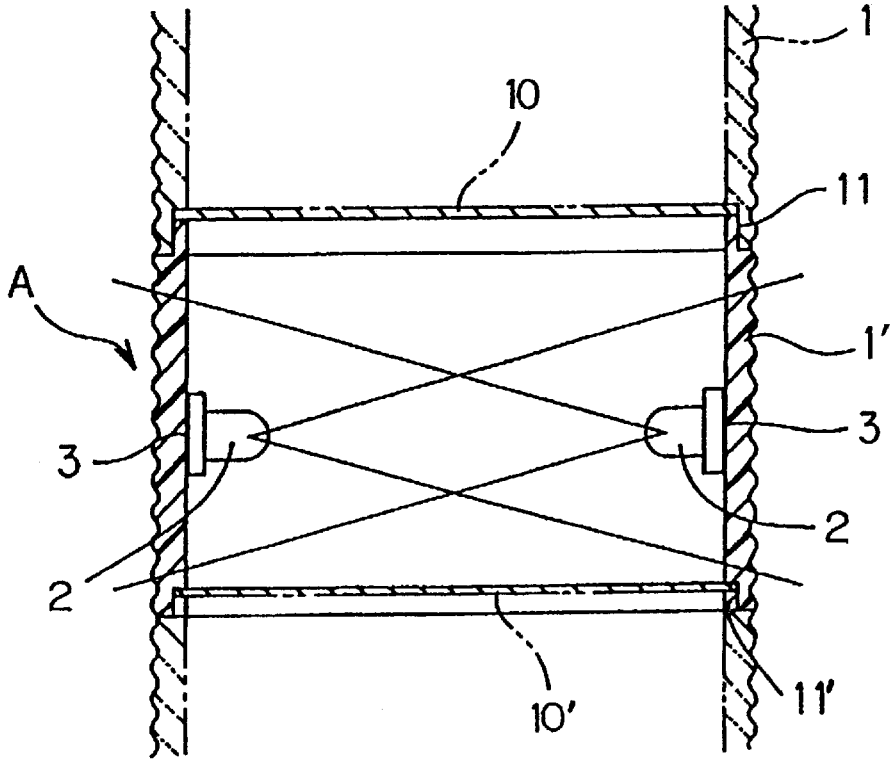
FIG. 2 is a cross-sectional view thereof.

FIGS. 1 and 2 respectively show a top view and a cross sectional view of the LED indicator lamp according to a first embodiment of the present invention. In FIG. 2, only the LEDs located at both ends in this cross sectional view are shown, and other LEDs are omitted in FIG. 2 and in other figures that show the cross sectional view of the indicator lamp.

The indicator lamp A comprises a globe 1, which is the light illuminating part of the lamp; and this globe 1, which may be of one or more stages, is made of a material such as glass and a synthetic resin that will transmit light. FIG. 2 shows a three (3) stage globe. The indicator lamp A further includes LEDs (light emitting diodes) 2 that are installed inside the globe 1 as a light source. In the shown embodiment, with the use of mounts 3, six (6) LEDs 2 are directly disposed at prescribed intervals on the inner circumferential surface of the globe 1 as seen from FIG. 1. As in the following embodiments of the present invention, the LEDs 2 are positioned at substantially the midpoint with reference to the height of the globe 1 which is a hollow cylinder.

The mounts 3 may be attached by various means including adhesive, screws, etc.; and they may be installed by spot-welding them to metal inserts embedded in the globe 1 and to metallic mounting seats of the LEDs 2. The electrical connections for the LEDs 2 are made by commonly known methods and are, therefore, not shown in the figures.

Reference numerals 11 and 11' are engagement areas of upper and lower globes 1 and 1', and the upper and lower globes 1 and 1' are joined to each other with shade plates 10 and 10' disposed in between. The shade plates 10 and 10' prevent illumination in a mixture of colors when LEDs of different colors are used in upper and lower globes 1 and 1'. They also prevent the light of the lighted LEDs from entering into a globe that contains turned-off LEDs. Thus, a globe in which the LEDs are turned off are not misinterpreted as a lighted-up globe by an observer.

With the structure described above, light emitted from each one of the LEDs 2 diffuses as it approaches the area of the inner circumference of the globe 1 that is substantially diametrically opposite from the light-emitting LED 2 and is transmitted through the globe 1 to the outside. Since there is adequate distance between each of the LEDs 2 and its opposite-side (or facing) inner circumferential surface of the globe 1, a high diffusion efficiency can be obtained. Thus, the LED 2 illumination fields are larger toward the outside, and it is possible to greatly improve the visibility of the indicator lamp without the use of any reflecting means in the globe 1. Therefore, a more efficient use of LEDs is assured, and the same illumination effect can be obtained with fewer LEDs, thus conserving energy.

Though not shown in FIGS. 1 and 2, slits are formed, as widely known, in the inner and outer surfaces or either one of the outer and inner surfaces of the globe 1 so that the globe 1 can function as diffusion lenses. Formed as part of the globe 1 are conductor paths that form an electrical circuit that supplies electrical power to the LEDs 2.

In the above embodiment, the LEDs 2 are directly attached to the globe 1. In the embodiments of the present invention to be described below, however, for easier installation of the LEDs 2, the LEDs are mounted on a ring-shaped base, and this ring-shaped base is provided in the globe so that the LEDs are disposed on the inner circumferential surface or in the vicinity thereof.

Figure 3:
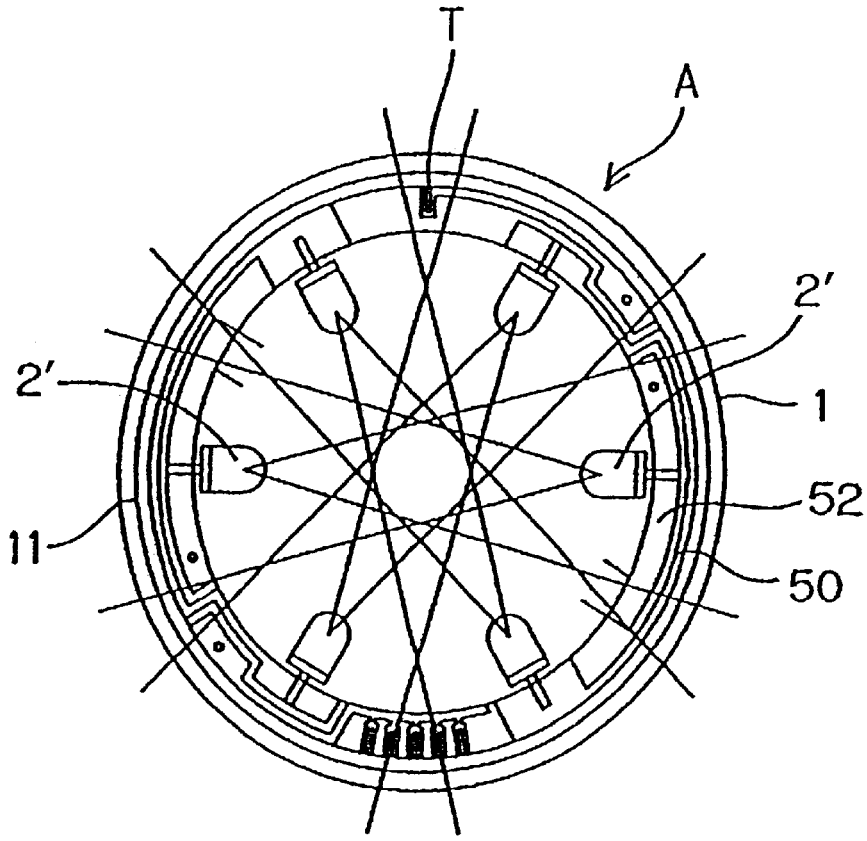
FIG. 3 is a top view of the second embodiment of the present invention.
Figure 4:
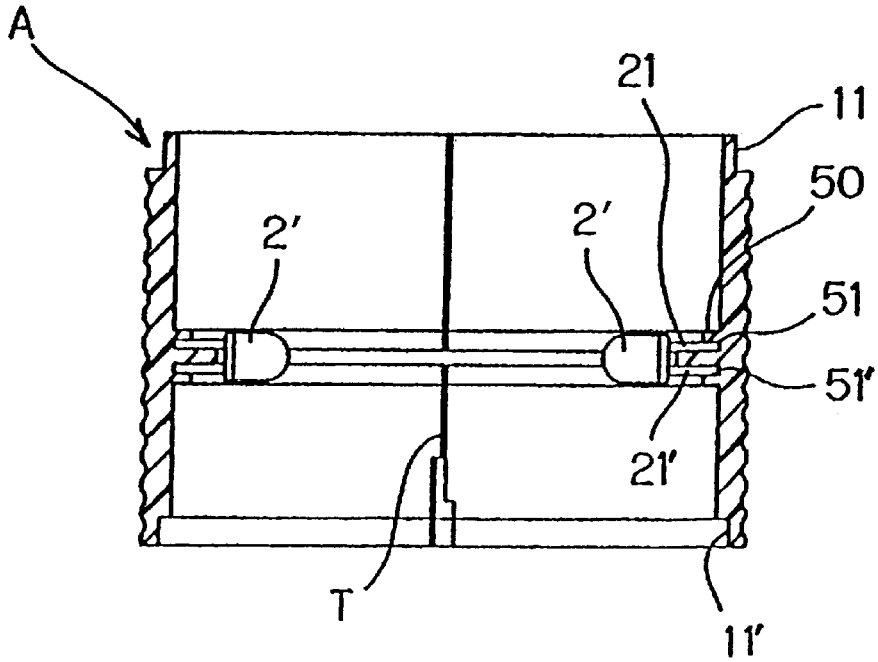
FIG. 4 is a cross-sectional view thereof.

In the embodiment shown in FIGS. 3 and 4, an inner rib 50 is formed on the inner circumferential surface of the globe 1, both of them being made of a material such as synthetic resin, glass and the like. In this embodiment, the rib 50 serves as a ring-shaped base so that the LEDs are installed thereon.

Figure 5:
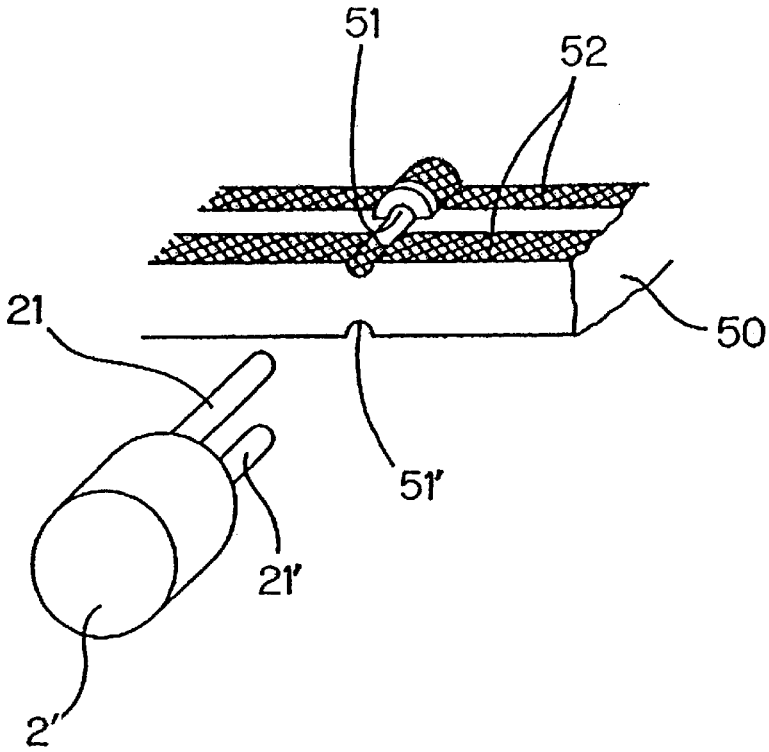
FIG. 5 is a perspective view of a portion of the LED indicator lamp of the second embodiment of the present invention.

As seen from FIG. 5, the rib 50 is provided with leg receivers 51 and 51', and the legs 21 and 21' of the LED 2' are inserted and fitted into the leg receivers 51 and 51'. The terminal T shown in FIG. 3 supplies power to the LEDs 2'. Preferably, a coating 52 is formed on the surface of the rib 50 so as to form an electrical circuit that is an equivalent to a printed circuit board.

As seen from the above, installing the LEDs 2' in the rib 50 which is integrally formed on the inner surface of the globe 1 means that the LEDs 2' are connected to the wiring of globe 1. In other words, the wiring board is formed as an integral part of the globe 1, eliminating the need to prepare a wiring board when manufacturing the globe. This can contribute to reduce both the number of parts and labor.

Figure 6:
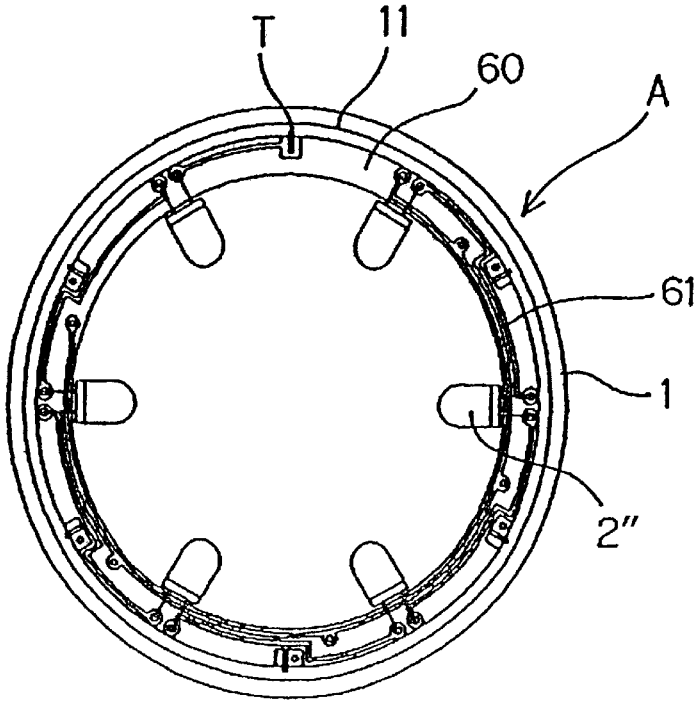
FIG. 6 is a top view of the third embodiment of the present invention.
Figure 7:
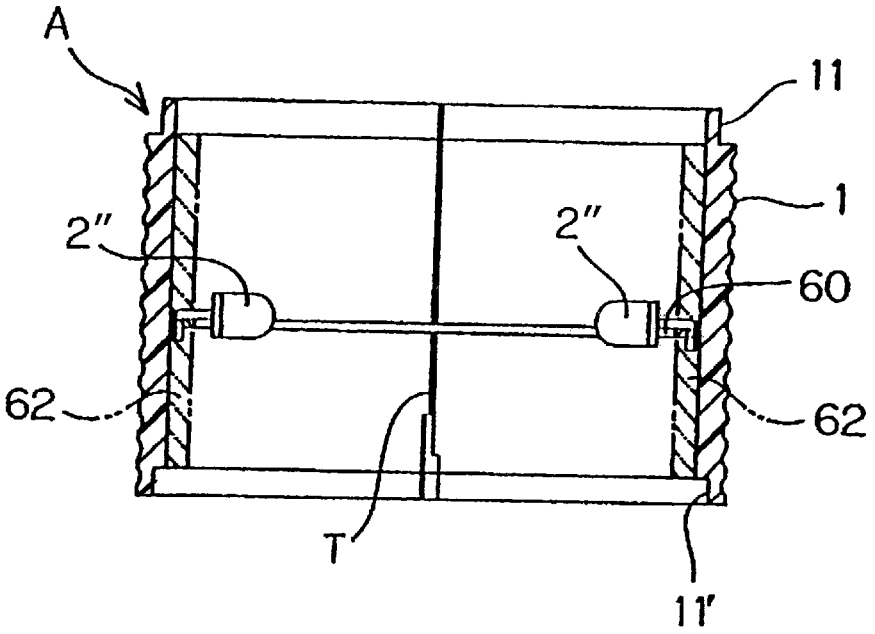
FIG. 7 is a cross-sectional view thereof.

FIGS. 6 and 7 show another embodiment of the present invention; and in this embodiment, a circular narrow plate 60 is provided around the inner circumference of the globe 1 so as to form the ring-shaped base. The narrow plate 60 is provided inside the globe 1 using an engagement means such as a key and slotted receiver arrangement or using a screw-type attachment means.

This configuration provides improved convenience in that a plurality of LEDs 2" can be mounted at appropriate intervals on the narrow plate 60 before installing the narrow plate 60 in the globe 1. It is more convenient when the narrow plate 60, used as a ring-shaped mounting base, is provided with printed wiring 61 so as to form a circuit board. In this embodiment, since the ring-shaped mounting base and the globe 1 are separate units, mounting bases may have various heights so as to comply with the heights of various globes. Also, the narrow plate 60, which is the LED mounting base, can be divided into multiple units.

The narrow plate 60 can be more stable in the globe by way of providing, at a plurality of locations, vertical support posts 62 (indicated by dotted lines in FIG. 7). In addition, such posts 62 can be conductors so that they supply power to other globes provided above and/or below.

Figure 8:
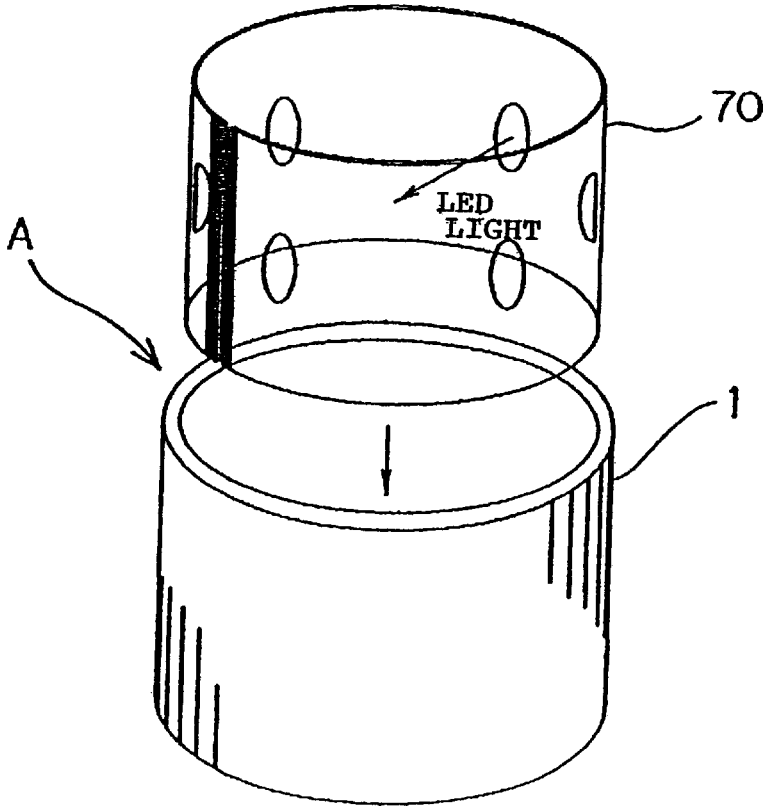
FIG. 8 is a perspective view of the fourth embodiment of the present invention.
Figure 9:
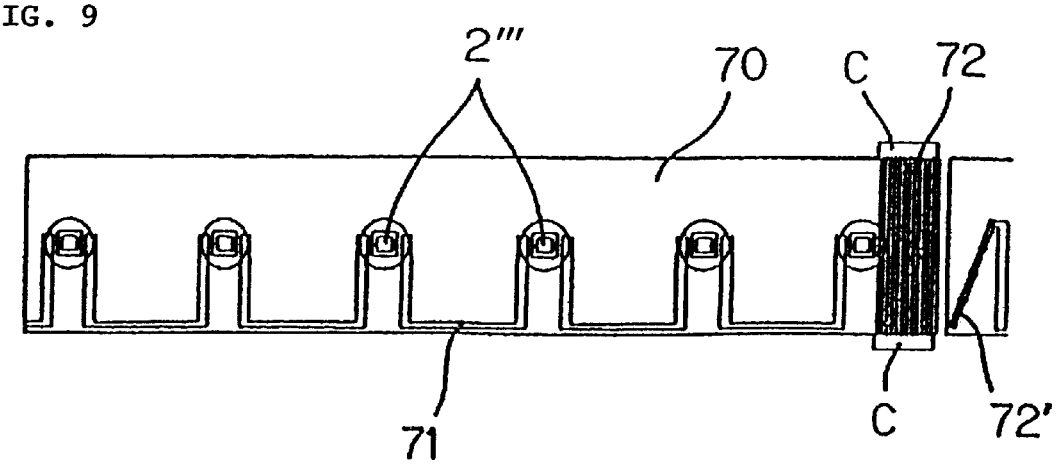
FIG. 9 is an extended view thereof.

A still another embodiment is shown in FIGS. 8 and 9.

In this embodiment, a cylinder 70 is formed from sheeting or film, and this cylinder 70 is installed around the inner circumferential surface of the globe 1 as the ring-shaped mounting base. A plurality of LEDs 2''' are disposed at appropriate intervals in the cylinder 70. The LEDs 2''' are interconnected by a conductive film 71 that is attached to the cylinder 70 by means of embedding, bonding and the like. Electrical connection is obtained through connectors C which are provided at the joints 72 and 72' of the sheeting or film that forms the cylinder 70. The connectors C are connected to mating connectors which are provided in a power supply (not shown) installed in the globe 1.

It is preferable that the cylinder 70 be transparent to improve the diffusion of light emitted from the LEDs 2'''.

Figure 10A:
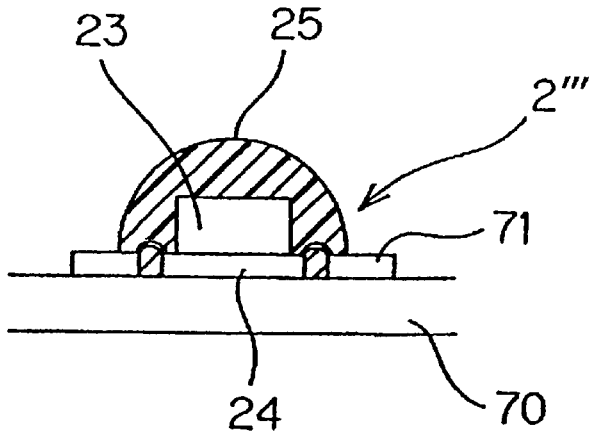
FIGS. 10(*a*) and 10(*b*) are partial cross-sectional views thereof.
Figure 10B:
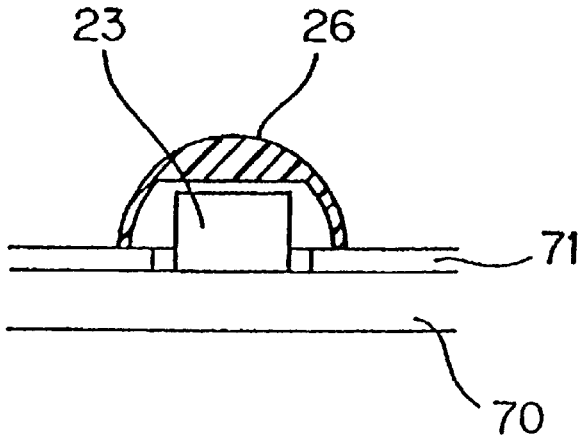

FIGS. 10(*a*) and 10(*b*) show the manner of mounting the LEDs 2''' on the cylinder 70 in this embodiment.

In FIG. 10(*a*), the mounting of LEDs on the cylinder 70 and coating on the LEDs are performed during fabrication of the film. In other words, a reflector 24 is provided behind an LED chip 23, and a coating 25 is applied on the front side of the LED chip 23. The coating 25 converges the light emitted from the LED and protects the LED from physical damage. In FIG. 10(*b*), an LED chip 23 is mounted on a conductive film 71, and the thus mounted LED chip 23 is covered by a lens cover 26 to form the LED 2'''. The lens cover 26 converges the LED light and protects the LED from damage.

In both cases shown in FIGS. 10(*a*) and 10(*b*), the LEDs 2''' are arranged on the cylinder 70 so as to form desired graphics and/or text. The cylinder 70 is made of sheeting or film; thus it can substantially reduce both the weight and the cost of the indicator lamp.

A further embodiment of the present invention is shown in FIGS. 11, 12 13 and 14.

In this embodiment, a plurality of frames 80 are connected together so as to form a ring, and these connected frames 80 are disposed around the inner circumference of the globe 1. The frames 80 are made of a conductive material (e.g. thin-pressed sheet), and the LEDs 2''' are mounted between adjacent frames 80 by, for instance, soldering. End joints 81 and 81' serve as electrical connections and join the frames 80 together to form a ring shape as in the embodiment of FIG. 8.

In this embodiment, the number of LEDs $\mathbf{2}^{iv}$ can be increased by increasing the number of frames 80 and thus increasing the number of connections between the frames 80. In any case, the vertical spacing between constituting components of the frame 80 needs to be set so as not to degrade the diffusion characteristics of the light emitted from the LEDs $\mathbf{2}^{iv}$.

The embodiment of FIGS. 11 through 14 contributes a weight and cost reduction. Before installation in the globe 1, the frames 80 are preferably wound in a reel form for easy storage.

Figure 15:
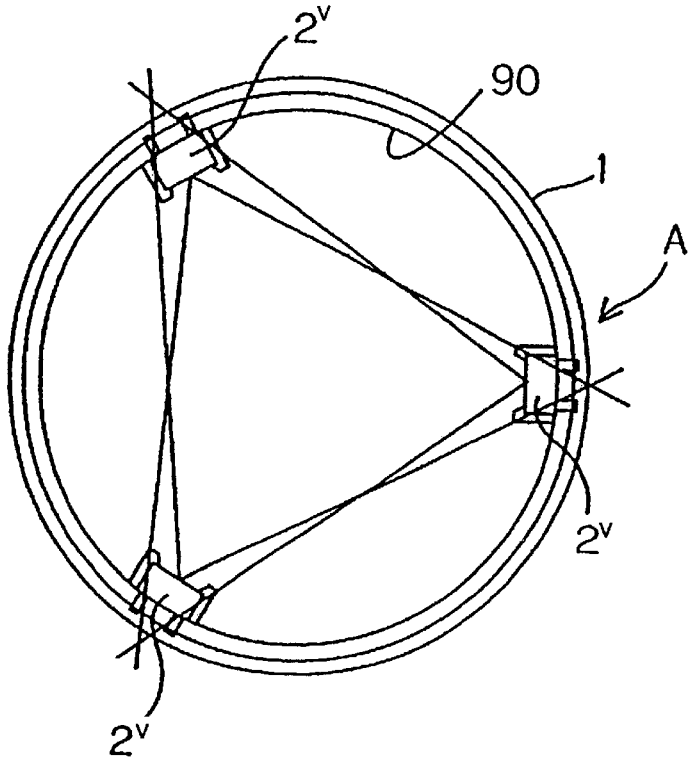
FIG. 15 is a top view of the sixth embodiment of the present invention.
Figure 16:
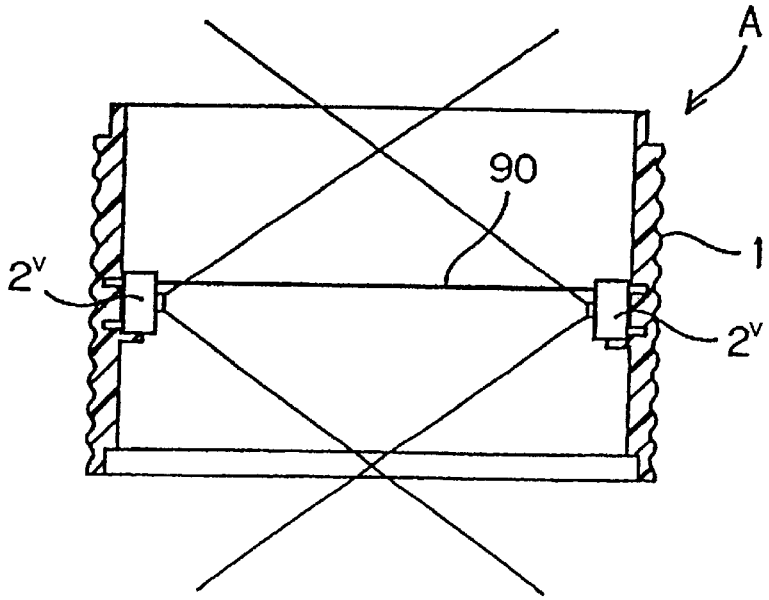
FIG. 16 is a cross-sectional view thereof.

Furthermore, in the embodiment shown in FIGS. 15 and 16, a wire 90 is used as the ring-shaped base.

The wire 90, with LEDs $\mathbf{2}^{v}$ attached to it, is provided around the inner circumferential surface of the globe 1, so that the LEDs $\mathbf{2}^{v}$ are provided around the inner circumference of the globe 1. This embodiment provides an even lighter and simpler means for mounting the LEDs $\mathbf{2}^{v}$ in globes. Since a wire is used, blocking of LED light is minimized.

Figure 17:
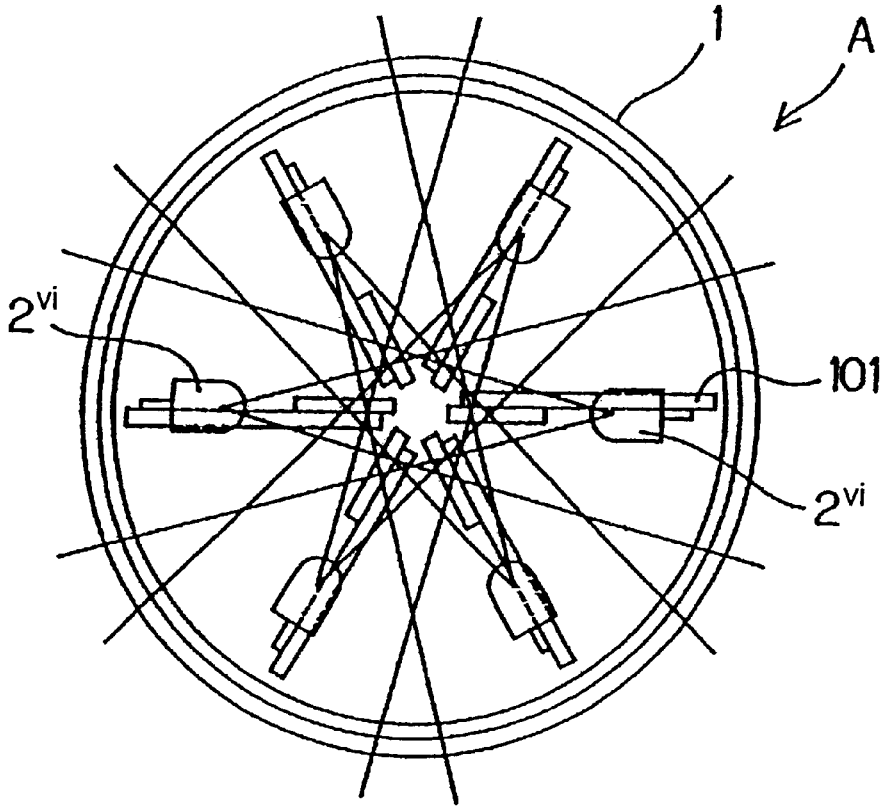
FIG. 17 is a bottom view of the seventh embodiment of the present invention.
Figure 18:
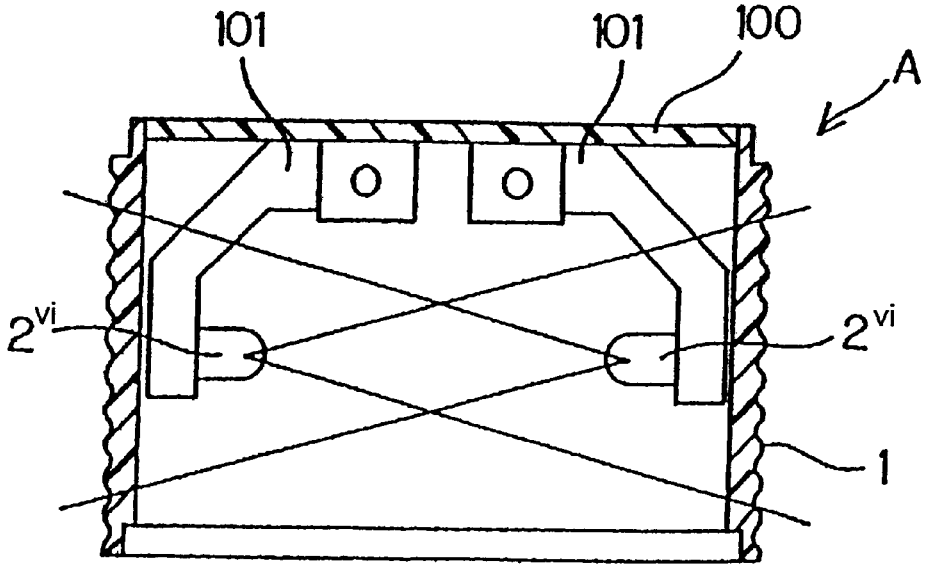
FIG. 18 is a cross-sectional view thereof.

FIGS. 17 and 18 show still another embodiment of the present invention.

In the previous embodiments, the LEDs $\mathbf{2}^{vi}$ are attached to the globe 1 directly or indirectly. However, in the embodiment of FIGS. 17 and 18, the shade plate 10 of the globe 1 is used for installation the LEDs. In other words, the shade plate 10 is provided with a plurality of connecting members 101 that extend downward in the globe 1, and each LED $\mathbf{2}^{vi}$ is attached to an inward-facing side of each one of the connecting members 101.

With this structure, a plurality of LEDs $\mathbf{2}^{vi}$ are positioned near the inner circumference of the globe 1; and light is emitted from the LED $\mathbf{2}^{vi}$ diametrically toward the opposite inner circumference of the globe 1 (the surface facing the LED) and diffused. Since no special working needs to be done to the globe, the LED mounting configuration of this embodiment can be used in globes on the market. Also, in this embodiment, the globe and light source can be replaced easily.

Furthermore, in the embodiment of FIGS. 17 and 18, the connecting members 101 are suspended downward from the shade plate 100 provided on the upper edge of the globe 1. Though not shown in the figures, the connecting member can be installed in the globe so as to extend upward from a shade plate disposed at the bottom of the globe 1.

Figure 11:
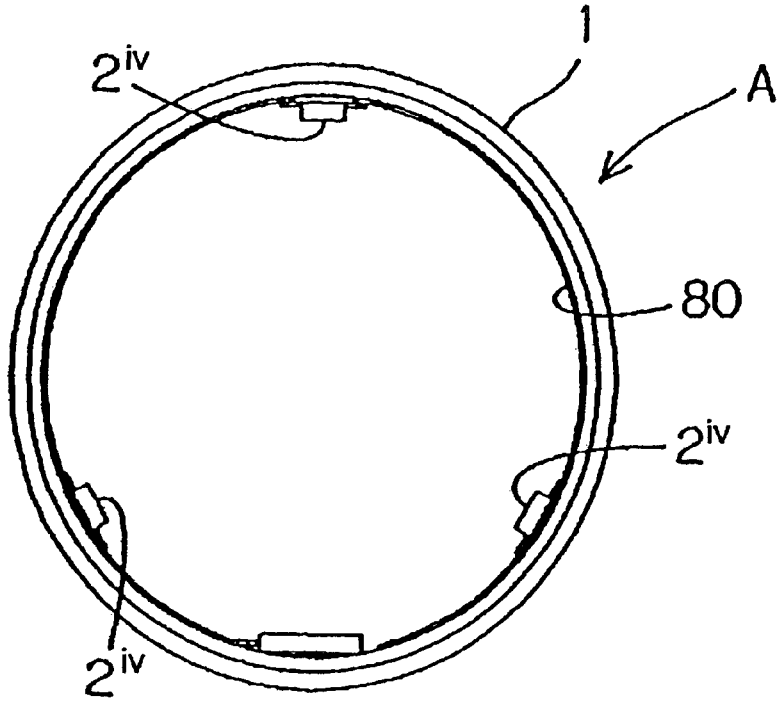
FIG. 11 is a top view of the fifth embodiment of the present invention.
Figure 12:
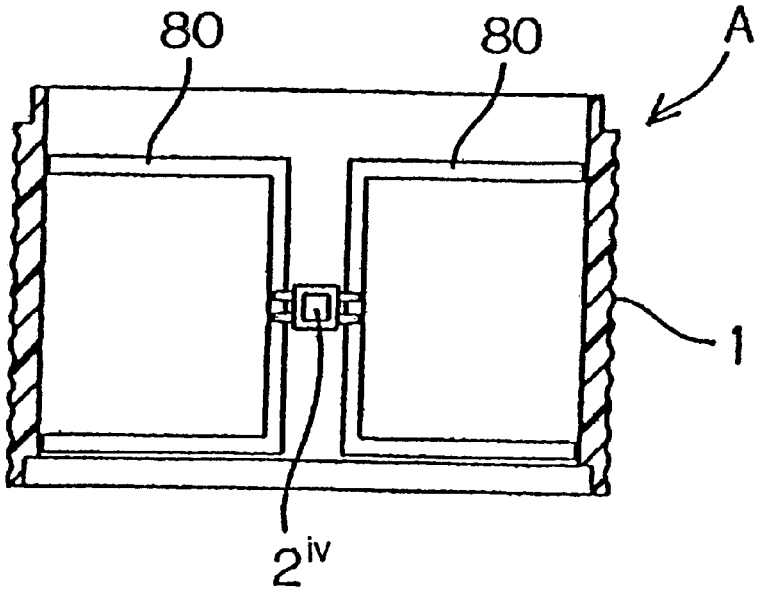
FIG. 12 is a cross-sectional view thereof in one direction.
Figure 13:
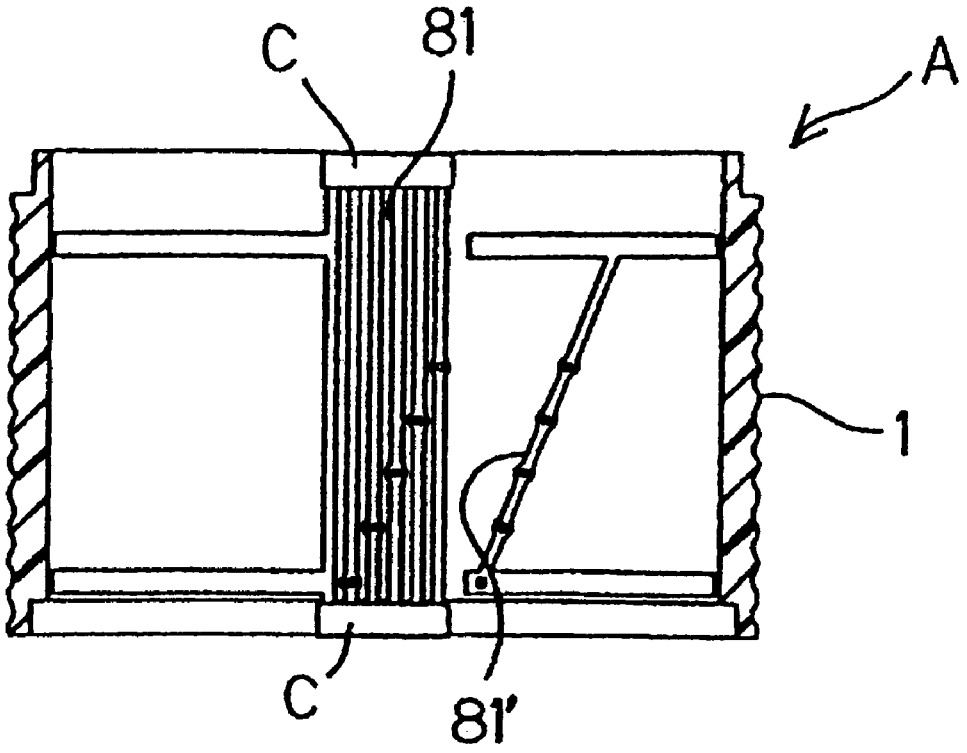
FIG. 13 is a cross-sectional view thereof in another direction.
Figure 14:
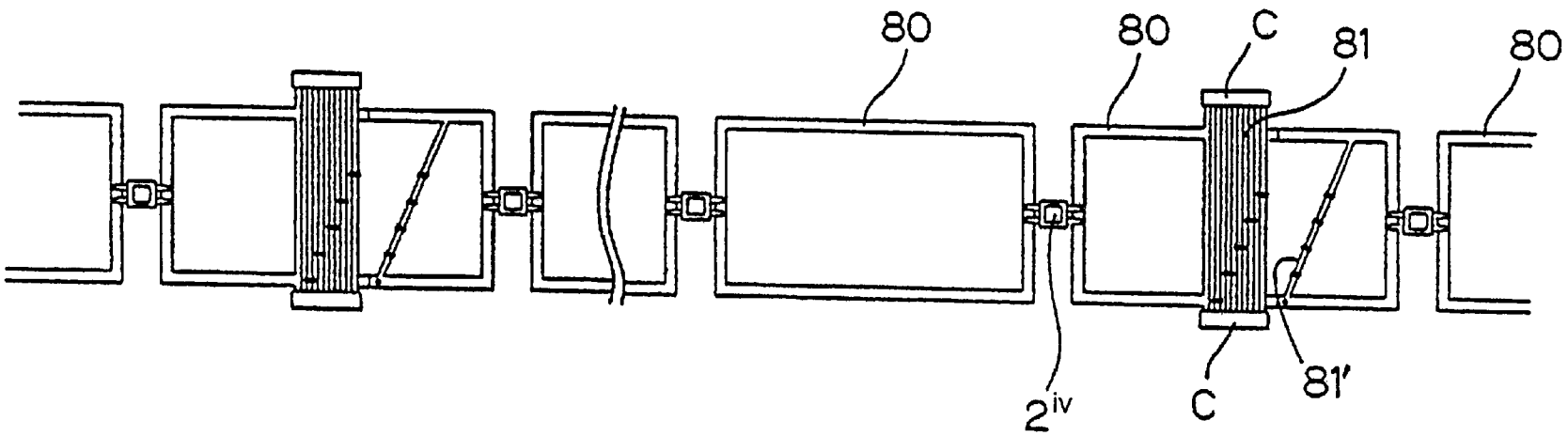
FIG. 14 is an extended view of the fifth embodiment of the present invention.

In either case, the LEDs can be mounted to the connecting members 101 during fabrication of the shade plate. Also, in lieu of an arm-like or C-shaped connecting member 101 as shown in FIG. 18, a transparent cylinder such as that shown in FIG. 8 or a ring base made up of frames as shown in FIG. 11 can be used for connecting the LEDs to the shade plate 100.

Figure 19:
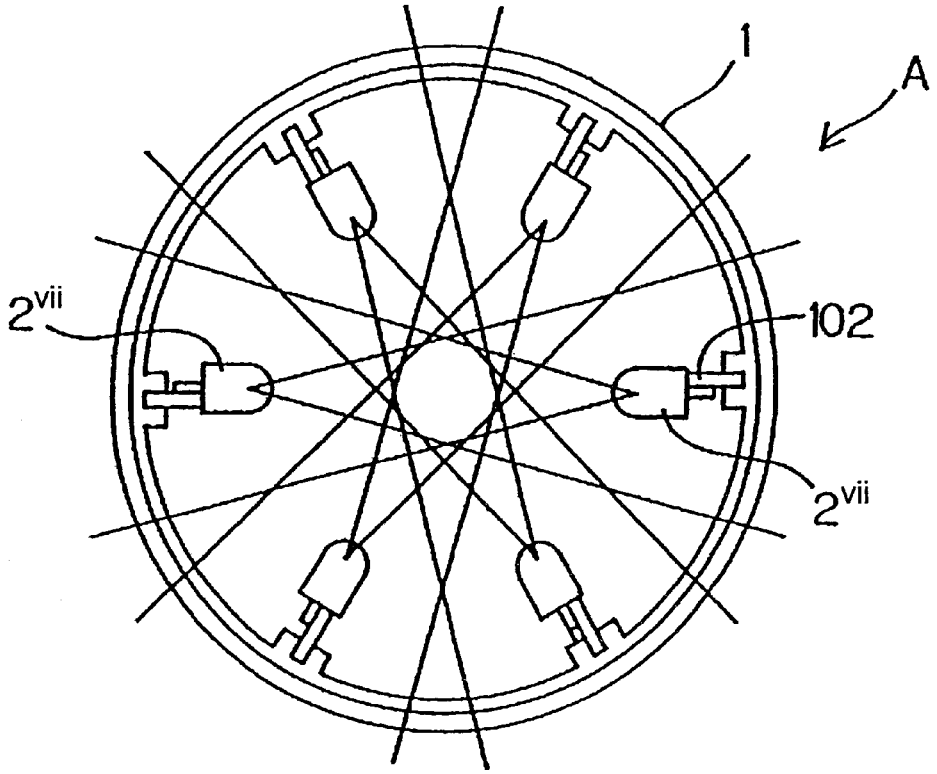
FIG. 19 is a top view of the eighth embodiment of the present invention.
Figure 20:
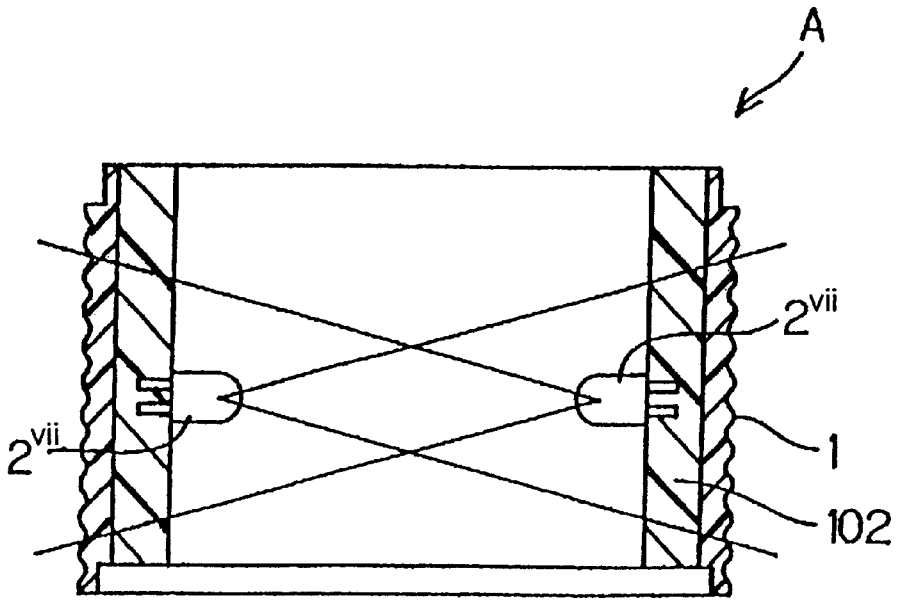
FIG. 20 is a cross-sectional view thereof.

FIGS. 19 and 20 show still another embodiment of the present invention.

In this embodiment, a plurality of oblong plates 102 of appropriate length (being substantially the same as the height of the globe 10) are provided around the inner surface of the globe 1 with equal spacing in between, and LEDs $\mathbf{2}^{vii}$ are attached on the inner edges of these oblong plates 102 so that the LEDs $\mathbf{2}^{vii}$ are oriented toward the center of the globe.

Since the oblong plates 102 are easy to handle, the structure of this embodiment is extremely cost-effective.

Figure 21:
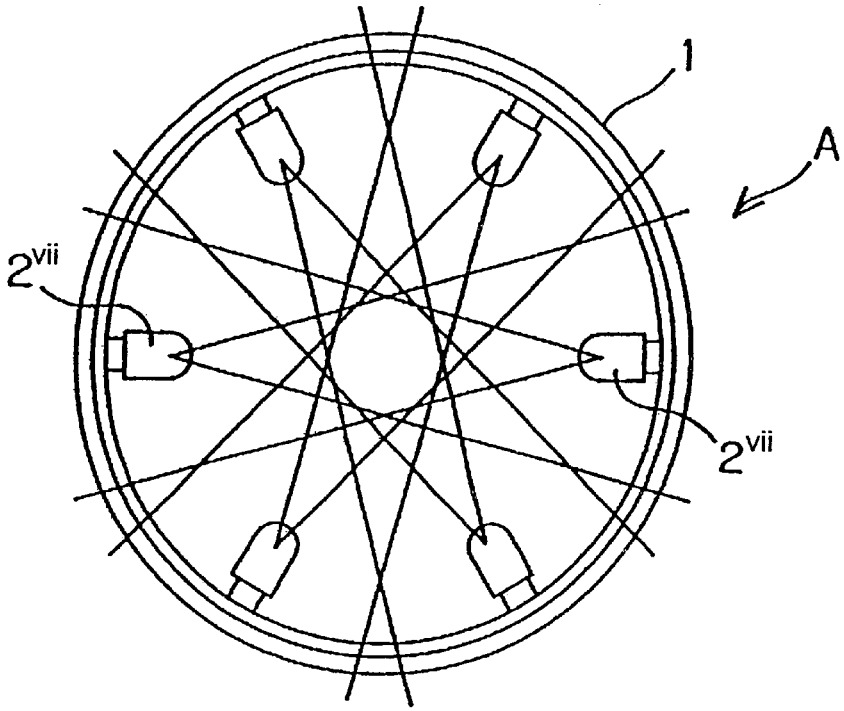
FIG. 21 is a top view of the ninth embodiment of the present invention.
Figure 22:
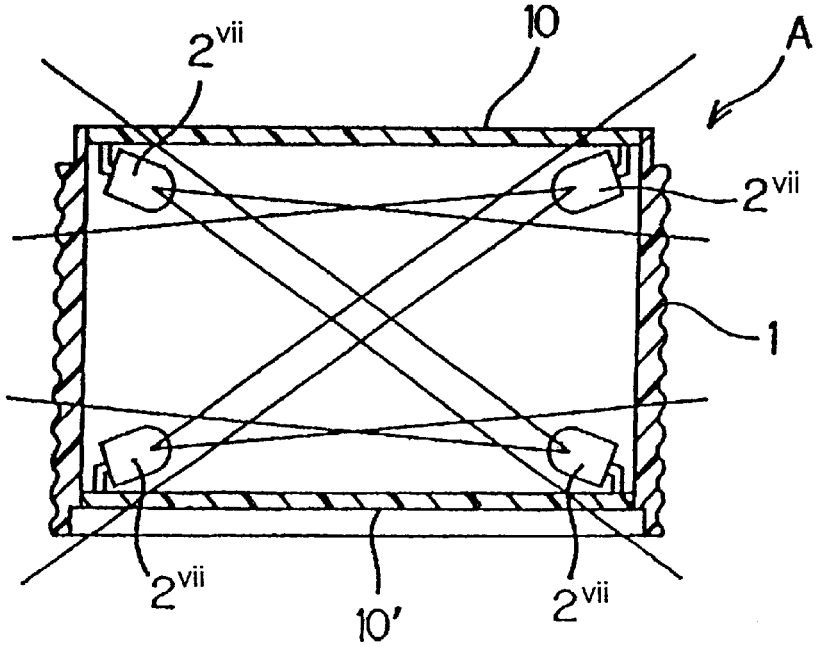
FIG. 22 is a cross-sectional view thereof.

In the above embodiments, the LEDs $\mathbf{2}^{vi}$ are installed so as to be oriented straight to the diametrically opposite side of the globe 1, and their light is emitted directly to the facing side. Instead, as shown in FIGS. 21 and 22, the LEDs $\mathbf{2}^{vii}$ can be installed on the upper and lower shade plates 10 and. 10' so that their light is emitted obliqiuely.

With this structure, the direction in which the light is emitted can be changed to obtain different lighting effects. Accordingly, it is possible to expand the manner of usage of the indicator lamp. Though not shown, LEDs that emit light obliquely may be provided on the upper or lower shade plate only.

Also, by successively flashing the LEDs $\mathbf{2}^{vii}$ provided at appropriate intervals around the inner circumference of the globe in the circumferential direction, it is possible to make the indicator lamp as if it is rotating. As. a result, an effect of a rotating illuminator or warning lamp is obtained.

Figure 23:
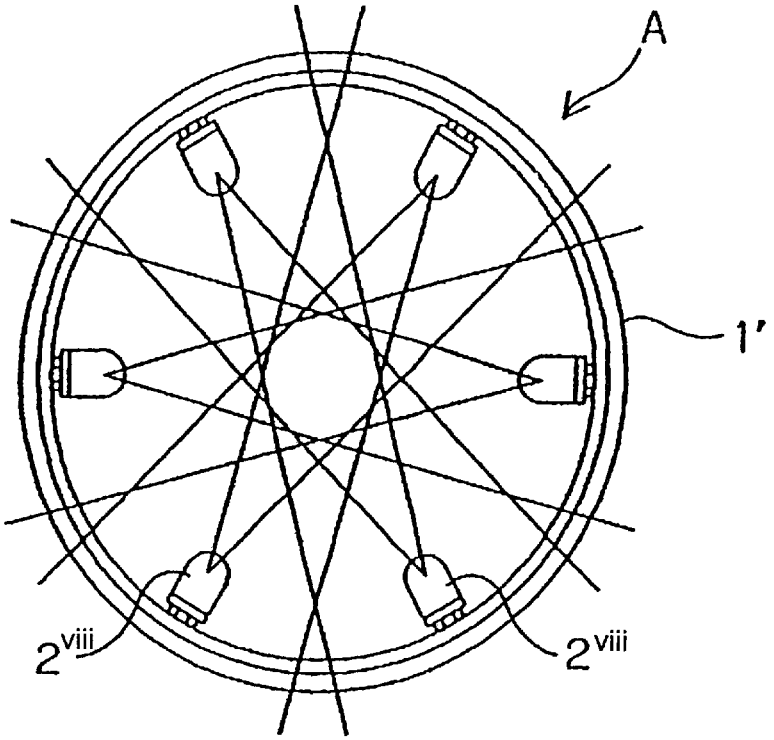
FIG. 23 is a top view of the tenth embodiment of the present invention.
Figure 24:
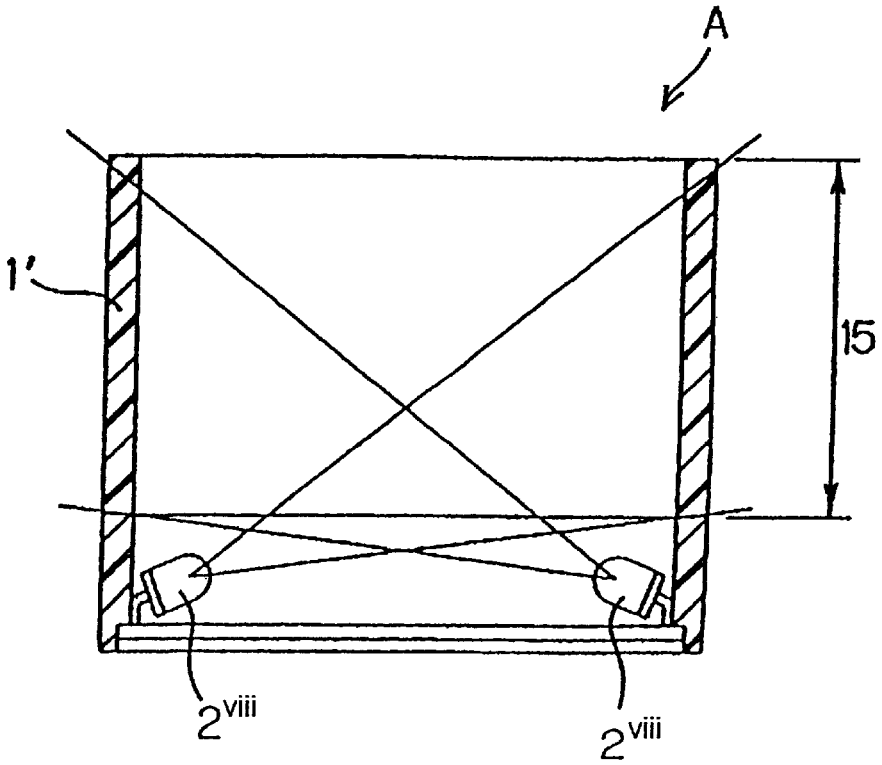
FIG. 24 is a cross-sectional view thereof.

Each of the above embodiments of the present invention is described with reference to the globe that is capable of transmitting light. In the embodiment shown in FIGS. 23 and 24, however, the globe is formed as a liquid crystal panel 1'. As a result, the light emitted from the LEDs $\mathbf{2}^{viii}$ serves as a backlight for the display 15 of the liquid crystal panel 1'. Text, symbols and graphics generated on the liquid crystal display can be displayed on the surface of the globe (a liquid crystal panel) as the information to be conveyed to an observer. Any manner of installing the LEDs in the globe described in the previous embodiments can be employed "as is" in this embodiment in which the globe is a liquid crystal panel.

In the above embodiments, a circular cylindrical hollow globe is used. However, the globe can be in fact in any other non-cylindrical shape such as a polygonal cylinder.

In use of the indicator lamp of the present invention, the light sources that work well in the structures of the above embodiments are high-directivity LEDs. In comparison, light sources such as common light bulbs that emit uniformly in all directions have almost no advantages. Even with prior art structures, LEDs with large illumination angles can light a fairly large area; however, in the present invention, these same LEDs will light a much larger area, thus making more effective use of the LED light.

Figure 25A:
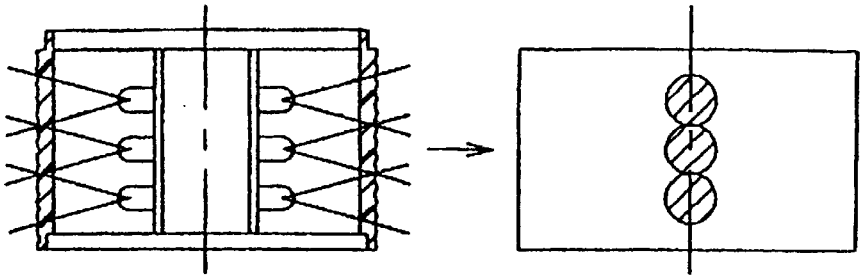
FIGS. 25(*a*), 25(*b*) and 25(*c*) show a comparison of illumination fields obtained by the use of standard convergence LEDs.

FIGS. 25(*a*), 25(*b*) and 25(*c*) show the differences in the illumination field provided by commonly used convergence-type LEDs. FIG. 25(*a*) shows a case in which the convergence-type LEDs are installed at the center of a globe, FIG. 25(*b*) shows a case in which the convergence-type LEDs are used together with a reflecting mirror, and FIG. 25(*c*) shows the structure of the present invention in which the convergence-type LEDs are provided on the inner circumferential surface of a globe. As seen from these figures, the visible illumination field obtained in the present invention is extremely larger than those obtained in the conventional lamp structure.

The same result is obtained when LEDs that have a large illumination angle are used. Compared to the conventional lamp structures shown in FIGS. 26(*a*) and 26(*b*), the visible illumination field obtained by the structure of the present invention is extremely large.

The above-described advantages of the present invention are summarized in the following comparison table.

TABLE 1

Figure 25B:
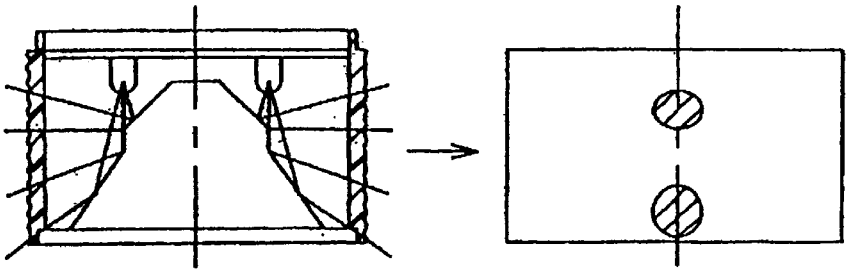
Figure 25C:
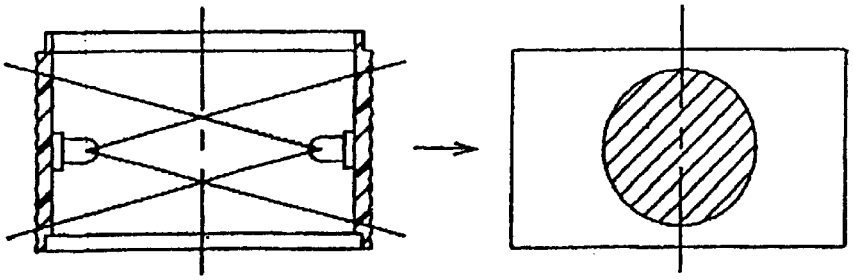
Figure 26A:
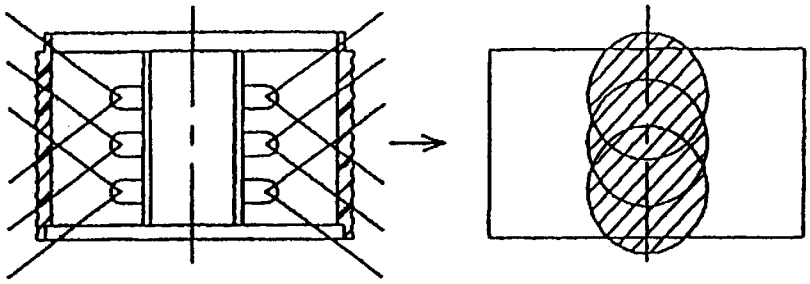
FIGS. 26(*a*), 26(*b*) and 26(*c*) show a comparison of illumination fields obtained by the use of wide-angle LEDs.
Figure 26B:
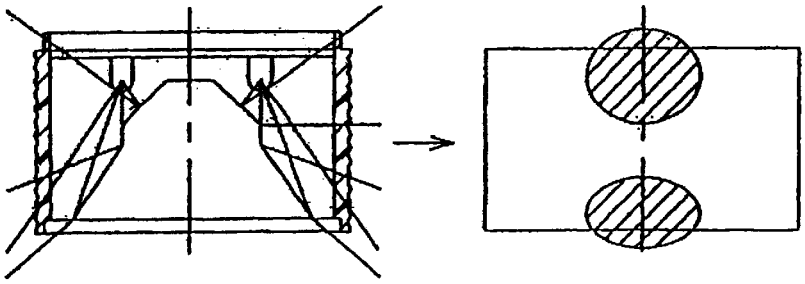
Figure 26C:
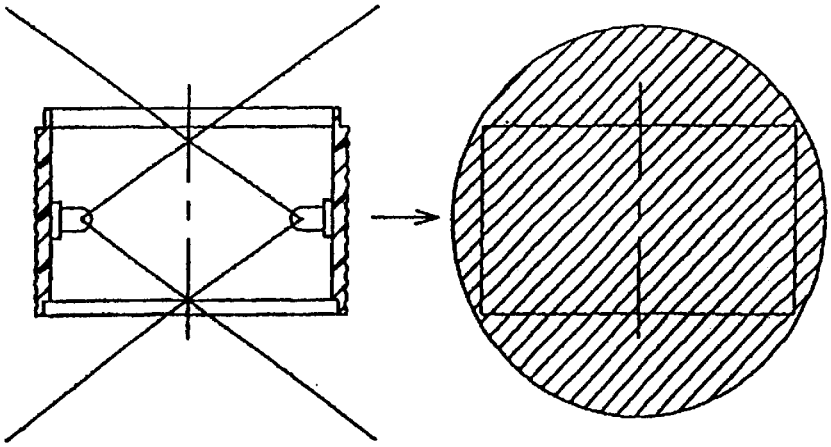

Figures 25 and 26 Compared

| | Structure Description | Advantages | Disadvantages |
|---|---|---|---|
| Centralized LED Type in Figures 25 (a) and 26(a) | Multiple printed circuit boards with LEDs mounted thereon are disposed from the center of a globe toward the outside. | Because there is nothing between the LEDs and globe surface, there is almost no attenuation of LED light. | Insufficient distance for adequate spreading of light from high directivity LEDs results in small illumination field. Thus, more LEDs are required, and more circuit boards are required. This increases complexity, which increases cost. |
| Reflecting Mirror Type in Figures 25(b) and 26(b) | PCB having multiple LEDs is set at the top of the globe with LEDs directed downward. Light emitted downward is then reflected outward by mirrors set in the center of the globe. | Because emitted light is converged by reflecting mirrors, adequate illumination field can be obtained with fewer LEDs | In the process of being emitted downward and reflected by the mirrors, the LED light is attenuated. |
| Present Invention in Figures 25(c) and 26(c) | LEDs are disposed on inner illuminating surface of globe and directed toward center. | Because there is nothing between LEDs and globe surface, there is almost no attenuation of LED light. LED illumination distance is the diameter of a globe and not radius. Thus, sufficiently uniform illumination is accomplished | None |

TABLE 1-continued

| Figures 25 and 26 Compared | | |
|---|---|---|
| Structure Description | Advantages | Disadvantages |
| | with half the diameter required in the prior art. Adequate illumination field can be obtained with fewer LEDs. Fewer parts, lower weight, lower power consumption, lower cost. | |

As seen from the above, the present invention solves problems associated with conventional indicator lamp configurations in which diffusing light is emitted toward the circumference of the globe (which is the illuminating surface of the lamp) from LEDs provided in the center of a globe and in which emitted diffusing light is reflected using a reflecting means such as a mirror to obtain adequate diffusion. Furthermore, the present invention provides the following effects:

1. Because no component is provided between the LEDs and globe surface, the LED light is not attenuated. Efficient use is thus made of the LED light.
2. Although the LEDs emit light from the inner circumference of the globe toward the center of the globe, there is no attenuation of light due to the crossing of LED light paths.
3. Light from the LEDs travels from locations around the inner circumference of a globe to areas of the circumference on the opposite side of the globe. Therefore, compared to conventional configurations in which the light travels only from the center to the circumference, the lamp of the present invention illuminates a field of the same size by a globe of half the diameter. For globes of the same diameter, the present invention may take twice the illumination distance.
4. Fewer parts are required. This means fewer parts to fail, improving reliability.
5. With the use of a bare minimum number of parts, the lamp is lighter and less susceptible to shock and vibration.
6. Fewer LEDs are required, thus conserving power. Fewer parts and simple structure provide cost savings.

What is claimed is:

1. A light-emitting diode indicator lamp comprising at least one globe and a light emitting diode installed in said globe as a light source, wherein a plurality of said light-emitting diodes are disposed at prescribed intervals on an inner circumference of said globe facing radially inwardly so that said light-emitting diodes provide a diffusing light toward areas that face said light-emitting diodes.

2. The light-emitting diode indicator lamp according to claim 1, wherein said plurality of light-emitting diodes are provided on a ring-shaped base installed around said inner circumference of said globe.

3. The light-emitting diode indicator lamp according to claim 2, wherein said ring-shaped base is formed as an integral part of said globe and comprises a rib provided on said inner circumference of said globe.

4. The light-emitting diode indicator lamp according to claim 2, wherein said ring-shaped base is a narrow plate installed around said inner circumference of said globe.

5. The light-emitting diode indicator lamp according to claim 2, wherein said ring-shaped base is a cylinder formed from sheeting or film and is installed around said inner circumference of said globe.

6. The light-emitting diode indicator lamp according to claim 2, wherein said ring-shaped base comprises a plurality of frames joined in a ring form and installed around said inner circumference of said globe.

7. The light-emitting diode indicator lamp according to claim 1, wherein said light-emitting diodes are provided on a member connected to a shade plate of said globe and positioned near said inner circumference of said globe.

8. The light-emitting diode indicator lamp according to any one of claims 1 to 6 or 7, wherein said globe is formed as a liquid crystal display panel.

9. The light-emitting diode indicator lamp according to any one of and claims 1 to 6 or 7, wherein said light emitting diodes are disposed so as to emit light in an oblique direction.

10. The light-emitting diode indicator lamp according to claim 9, wherein said globe is formed as a liquid crystal display panel.

11. A light-emitting diode indicator lamp comprising at least one globe and a light emitting diode installed in said globe as a light source, wherein:

a plurality of said light-emitting diodes are-disposed at prescribed intervals on or near an inner circumference of said globe, so that said light-emitting diodes provide a diffusing light toward areas that face said light-emitting diodes;

said plurality of light-emitting diodes are provided on a ring-shaped base installed around said inner circumference of said globe; and said ring-shaped base is a wire installed around said inner circumference of said globe.

12. The light-emitting diode indicator lamp according to claim 11, wherein said globe is formed as a liquid crystal display panel.

13. The light-emitting diode indicator lamp according to claim 11, wherein said light-emitting diodes are disposed so as to emit light in an oblique direction.

14. The light-emitting diode indicator lamp according to claim 13, wherein said globe is formed as a liquid crystal display panel.

15. A light-emitting diode indicator lamp comprising:

at least one globe which is substantially a hollow cylinder; and a plurality of light emitting diodes installed in said at least one globe so that-said plurality of light emitting diodes are spacedly disposed on an inner circumferential surface of said at least one globe with said plurality of light-emitting diodes facing radially inwardly and positioned at substantially midpoint with reference to a height of said globe.

* * * * *